US007721584B2

(12) United States Patent
Tokunaga et al.

(10) Patent No.: US 7,721,584 B2
(45) Date of Patent: May 25, 2010

(54) WORK CONVEYANCE DEVICE, PRESS MACHINE AND BAR REMOVAL METHOD

(75) Inventors: Hidekazu Tokunaga, Komatsu (JP); Masaaki Kashiwa, Komatsu (JP)

(73) Assignee: Komatsu Industries Corp., Komatsu-Shi (JP)

( * ) Notice: Subject to any disclaimer, the term of this patent is extended or adjusted under 35 U.S.C. 154(b) by 167 days.

(21) Appl. No.: 11/911,184

(22) PCT Filed: Apr. 10, 2006

(86) PCT No.: PCT/JP2006/307553

§ 371 (c)(1),
(2), (4) Date: Dec. 6, 2007

(87) PCT Pub. No.: WO2006/112289

PCT Pub. Date: Oct. 26, 2006

(65) Prior Publication Data

US 2009/0064753 A1 Mar. 12, 2009

(30) Foreign Application Priority Data

Apr. 14, 2005 (JP) ..... 2005-117453

(51) Int. Cl.
*B21J 11/00* (2006.01)

(52) U.S. Cl. ..... 72/405.09; 72/405.11; 72/405.13

(58) Field of Classification Search ..... 72/405.01, 72/405.05, 405.09, 405.11, 405.13, 405.16, 72/405, 12

See application file for complete search history.

(56) References Cited

U.S. PATENT DOCUMENTS 4,924,692 A 5/1990 Rieger et al.

(Continued)

FOREIGN PATENT DOCUMENTS

DE 38 12 365 A1 10/1989

(Continued)

OTHER PUBLICATIONS

German Office Action dated Dec. 10, 2008, and English translation thereof issued in counterpart German Application No. 11 2006 000 904.4-14.

(Continued)

*Primary Examiner*—Dana Ross
*Assistant Examiner*—Stephanie Jennings
(74) *Attorney, Agent, or Firm*—Frishauf, Holtz, Goodman & Chick, P.C.

(57) ABSTRACT

A plurality of workpiece holders 52 are attached on a slide plate 71 on a bar 14 and connected to a movable plate 72 by a plate connecting portion 73. The plate connecting portion 73 includes an engaging portion 731 that is provided on the movable plate 72 and an engaged portion 732 that is provided on the slide plate 71 and engaged with the engaging portion 731. By moving a fixed bar 141 downward relative to a movable bar 142, the movable bar 142 is detached and the engagement of the engaging portion 731 with the engaged portion 732 is released. Since both of the movable bar 142 and the slide plate 71 can be detached by a single downward movement of the fixed bar 141, no actuator is required, thereby simplifying the structure.

17 Claims, 10 Drawing Sheets

U.S. PATENT DOCUMENTS

| | | | | |
|---|---|---|---|---|
| 6,196,044 | B1 * | 3/2001 | Sofy | 72/405.13 |
| 2003/0051980 | A1 * | 3/2003 | Sofy | 198/621.1 |
| 2005/0056077 | A1 * | 3/2005 | Kawamoto | 72/405.1 |
| 2005/0166659 | A1 * | 8/2005 | Baba et al. | 72/405.09 |

FOREIGN PATENT DOCUMENTS

| | | | | |
|---|---|---|---|---|
| JP | 62161437 | A | * | 7/1987 |
| JP | 8-174106 | A | | 7/1996 |
| JP | 2583175 | Y2 | | 8/1998 |
| JP | 2002-178064 | A | | 6/2002 |
| JP | 2002-219535 | A | | 8/2002 |

OTHER PUBLICATIONS

Notification Concerning Transmittal of International Preliminary Report on Patentability, Chapter I of the Patent Cooperation Treaty, Oct. 16, 2007 for PCT/JP2006/307553, 4 sheets.

* cited by examiner

WORK CONVEYANCE DEVICE, PRESS MACHINE AND BAR REMOVAL METHOD

This application is a U.S. National Phase Application under 35 USC 371 of International Application PCT/JP2006/307553 filed Apr. 10, 2006.

TECHNICAL FIELD

The present invention relates to: a workpiece transfer device that transfers a workpiece to a subsequent step in a plurality of steps in press-processing; a press machine including the workpiece transfer device; and a bar-detaching method for detaching a bar of the workpiece transfer device.

BACKGROUND ART

A press machines such as a transfer press that conducts a plurality of steps in press-processing is provided with a workpiece transfer device that sequentially transfers a workpiece to a subsequent step. The workpiece transfer device includes a pair of bars disposed along a workpiece transfer direction, the pair of bars each having a workpiece holder for holding the workpiece. The pair of bars are moved in feed, lift and clamp directions to transfer the workpiece.

In the press machines, when a die is changed, the workpiece holder and the bars need to be replaced. Accordingly, each of the bars of a related-art workpiece transfer device is constituted by a portion fixed to the press machine and a portion for holding the workpiece holder, the two portions being separable from each other (see, for instance, Patent Document 1). In the workpiece transfer device disclosed in Patent Document 1, a first bar and a second bar of the bars are connected to each other and separated from each other by a connecting device.

The connecting device includes: a wedge-shaped member provided on the first bar; and an engaging claw provided on the second bar and engageable with the wedge-shaped member. The wedge-shaped member is provided on an end of a piston. When the piston is moved by air pressure, the wedge-shaped member protrudes toward the second bar to engage with the engaging claw, so that the first bar is connected with the second bar. To release the connection, a disconnecting device that is provided as a separate component from the connecting device opens the engaging claw to release the engagement of the wedge-shaped member.

[Patent Document 1] Japanese Utility Model Registration No. 2583175 (Pages 5 to 7, FIG. 1)

DISCLOSURE OF THE INVENTION

Problems to be Solved by the Invention

Recently, a workpiece transfer device that is provided with a feed carrier movable on a bar in a feed direction has been suggested. In such a workpiece transfer device, the plurality of feed carriers connected with each other by connecting members are disposed on each of the bars. The workpiece transfer carriers have a structure in which the plurality of feed carriers are moved on the bar in the feed direction in accordance with movement of the connecting members by a driver such as a liner motor.

In the workpiece transfer devices, when a die is replaced, the bar and the connecting members on which the feed carriers are connected need to be separated and detached. However, a structure that enables the separation and connection of the connecting members has not been developed. Granted that a conventional connecting device disclosed in the aforementioned Patent Document 1 is applied to the connecting members, the structure will be complicated. Further, the number of components will be increased, which causes difficulty in control, maintenance and the like and inefficiency in operation.

An object of the present invention is to provide a workpiece transfer device from which a bar can be easily detached with a simple structure, a press machine equipped with the workpiece transfer device and a bar-detaching method of the workpiece transfer device.

Means for Solving the Problems

A workpiece transfer device of a press machine according to an aspect of the invention includes: a pair of bars that are disposed substantially in parallel to a workpiece transfer direction; a workpiece holder that holds a workpiece; a feed driving mechanism that moves the workpiece holder in the workpiece transfer direction relative to the pair of bars; and a bar driving mechanism that drives the pair of bars at least either in a lift direction or in a clamp direction. The pair of bars each include a fixed bar that is fixed on the bar driving mechanism, a movable bar that is separable from the fixed bar and a bar connecting device that connects the fixed bar and the movable bar. The feed driving mechanism includes a slide member that is supported by the movable bar and slidable, a movable member that is supported by the fixed bar and slidable, a connecting portion that connects the slide member and the movable member and a feed driving source that is provided on the fixed bar and moves the movable member in the workpiece transfer direction. The connecting portion includes an engaging portion that is provided one of the slide member and the movable member and an engaged portion that is provided the other of the slide member and the movable member and engageable with the engaging portion. The engaging portion can engage with the engaged portion in a direction substantially orthogonal to a longitudinal direction of the pair of bars.

According to the aspect of the invention, since the connecting portion is provided between the slide member and the movable member, the slide member and the movable member can be separated from each other. Accordingly, when a die is exchanged, the bar is divided into the fixed bar and the movable bar and the slide member is separated from the movable member. Hence, it is possible to carry-out (carry-in) the slide member and the bar from (to) the press machine in the die replacement, which facilitates the die replacement.

The connecting portion includes the engaging portion and the engaged portion. The engaging portion can engage with the engaged portion in the direction substantially orthogonal to the longitudinal direction of the bar. Accordingly, by moving the fixed bar in the direction substantially orthogonal to the longitudinal direction of the bar relative to the movable bar, the engaging portion can engage with the engaged portion. Since the slide member and the movable member move in the longitudinal direction of the bar in a general workpiece transfer, the engagement between the engaging member and the engaged member will not be released. Thus, since the arrangement where the engaging portion engages with the engaged portion in the direction substantially orthogonal the longitudinal direction of the bar is employed, no conventional connecting device having an actuator, a disconnecting device or the like is required to separate the slide member from the movable member and to connect the slide member to the movable member. Hence, the structure of the workpiece transfer device can be simplified and the workpiece transfer device can be lighter in weight and smaller in size. Further, since the structure of the connecting portion can be also simplified, the number of components will be reduced, which decrease the costs of the workpiece transfer device while improving efficiency in maintenance.

In the workpiece transfer device of the press machine, the engaging portion may engage with the engaged portion in a vertical direction.

According to the aspect of the invention, since the engaging portion engages with the engaged portion in the vertical direction, the engaging portion can engage with the engaged portion by moving the fixed bar in the vertical direction relative to the movable bar. Also in a case where the bar driving mechanism of the workpiece transfer device of the press machine is equipped with a mechanism to move the bar in a lift direction, the bar driving mechanism can be used as it is to connect the slide member with the movable member and to separate the slide member from the movable member, so that the structure of the workpiece transfer device can be simplified and the connection and separation can be easily conducted.

In the workpiece transfer device of the press machine, the engaging portion may be formed in a substantially T-shape in plan view, and the engaged portion may be formed in a substantially C-shape in plan view.

According to the aspect of the invention, since the engaging portion is formed in the substantially T-shape in plan view and the engaged portion is formed in the substantially C-shape in plan view, the engaging portion can easily engage with the engaged portion and the engagement therebetween can be properly maintained without being released even when the slide member and the movable member are moved in a feed direction.

Note that the planes of the engaging portion and the engaged portion in plan view are orthogonal to a direction in which the engaging portion engages with the engaged portion. For example, when the engaging portion engages with the engaged portion in the vertical direction, the shapes of the planes parallel to the horizontal plane of the engaging portion and the engaged portion are the substantially T-shape and the substantially C-shape.

In the workpiece transfer device of the press machine, the fixed bars may be provided on ends of the movable bar, and the feed driving source may be provided to at least one of the fixed bars.

According to the aspect of the invention, since the fixed bar is provided on both ends of the movable bar, this structure in which the movable bar is supported at both ends achieves a stable transfer of the workpiece. When the feed driving source is provided on both of the fixed bars, output capacity per feed driving source may be small. On the other hand, when the feed driving source is provided either one of the fixed bars, the entire structure of the device can be simplified.

In the workpiece transfer device of the press machine, the bar connecting device may include: a fixed-side connecting portion that protrudes from an end of the fixed bar toward the movable bar; a movable-side connecting portion that protrudes from an end of the movable bar toward the fixed bar to overlap with the fixed-side connecting portion; and a holding means that is disposed in the fixed bar to hold the movable-side connecting portion against the fixed-side connecting portion by a holding member being advanced and retracted in a longitudinal direction of the fixed bar by air pressure.

According to the aspect of the invention, when the holding member is protruded in the longitudinal direction from the end of the bar by air pressure with the fixed-side connecting portion and the movable-side connecting portion overlapped, the movable-side connecting portion is held between the fixed-side connecting portion and the holding member. Accordingly, the fixed bar is connected with the movable bar. In order to detach the movable bar from the fixed bar, the holding member is evacuated by controlling the air pressure. Since the holding member protrudes and evacuates in the longitudinal direction of the fixed bar, the holding member will not be overlapped on the movable-side connecting portion when the holding member is evacuated. Hence, by moving the fixed bar relative to the movable bar, the movable-side connecting portion will be spaced from the fixed-side connecting portion, thereby releasing the connection between the fixed bar and the movable bar.

Since the holding member is advanceable and retractable by air pressure, the responsiveness will be excellent, so that the holding member can be moved in a speedy manner, thereby shortening die replacement time. Additionally, unlike the conventional control using hydraulic pressure, a complicate connecting device will not be required, so that the arrangement of the holding member can be simplified, thereby facilitating the control, operation and maintenance of the holding member.

Since the holding means is accommodated in the fixed bar, space efficiency of the workpiece transfer device can be enhanced, thereby promoting downsizing of the workpiece transfer device. Further, since the holding member protrudes and evacuates in the longitudinal direction of the fixed bar, the holding member will not be overlapped on the movable-side connecting portion when the holding member is evacuated. Hence, the movable-side connecting portion can be easily detached from the fixed-side connecting portion, which facilitates the detachment.

In the workpiece transfer device of the press machine, one of the fixed-side connecting portion and the movable-side connecting portion may be provided with a guide pin projecting toward the other of the fixed-side connecting portion and the movable-side connecting portion, and the other of the fixed-side connecting portion and the movable-side connecting portion may be provided with a guide hole in which the guide pin is inserted.

According to the aspect of the invention, since the guide pin projects toward either of the fixed-side connecting portion or the movable-side connecting portion, the guide pin can be inserted into the guide hole at the same time when the fixed-side connecting portion is moved to be overlapped on the movable-side connecting portion. Hence, the fixed-side connecting portion and the movable-side connecting portion can be easily positioned.

In the workpiece transfer device of the press machine, the bar driving mechanism may move the fixed bar in the direction substantially orthogonal to the longitudinal direction of the pair of bars relative to the movable bar such that the fixed-side connecting portion and the movable-side connecting portion are overlapped with each other or spaced from each other while the connecting portion engages with or disengages from the connecting portion.

According to the aspect of the invention, since the connecting portion is connected or released at the same time when the fixed-side connecting portion and the movable-side connecting portion are overlapped or spaced, no conventional connecting device having an actuator, a disconnecting device or the like is required to separate the slide member from the movable member and to connect the slide member to the movable member. Hence, the structure of the workpiece transfer device can be simplified and the workpiece transfer device can be lighter in weight and smaller in size. Further, since the structure of the connecting portion can be also simplified, the number of components will be reduced, which decreases the costs of the workpiece transfer device while improving the efficiency in maintenance.

A press machine according to an aspect of the invention is provided with the above-described workpiece transfer device of the press machine.

According to the aspect of the invention, since the press machine is provided with the above-described workpiece transfer device of the press machine, the advantages same as those of the above-described workpiece transfer device of the press machine can be achieved, whereby the weight and size thereof can be reduced and the efficiency in maintenance can be improved. In addition, since the bar can be easily detached, the die replacement will be easy, so that the die replacement time can be shortened.

A bar detaching method of the above-described workpiece transfer device of the press machine according to an aspect of the invention includes: a positioning process in which the feed driving mechanism moves the connecting portion to a position corresponding to that of the bar connecting device; and a connection-releasing process in which the bar driving mechanism moves the fixed bar in the direction substantially orthogonal to the longitudinal direction of the pair of bars relative to the movable bar to release a connection of the bar connecting device and a connection of the connecting portion.

According to the aspect of the invention, the bar connecting device and the connecting portion are positioned in the positioning process. When the fixed bar is moved relative to the movable bar in the connection-releasing process, the connection of the bar connecting device is released and the engagement of the engaging portion with the engaged portion is released. In other words, a single movement can detach both of the bar connecting device and the connecting portion, which facilitates the bar detachment. Further, since the slide member and the movable member are connected by the engagement between the engaging portion and the engaged portion, an actuator used in a conventional connecting device will not be required. Hence, when the slide member and the movable member are connected with each other in the die replacement, operation checking of the actuator or the like will be unnecessary, thereby further simplifying the die replacement. Therefore, the die replacement time can be shorter.

EXPLANATION OF CODES

Figure 1:
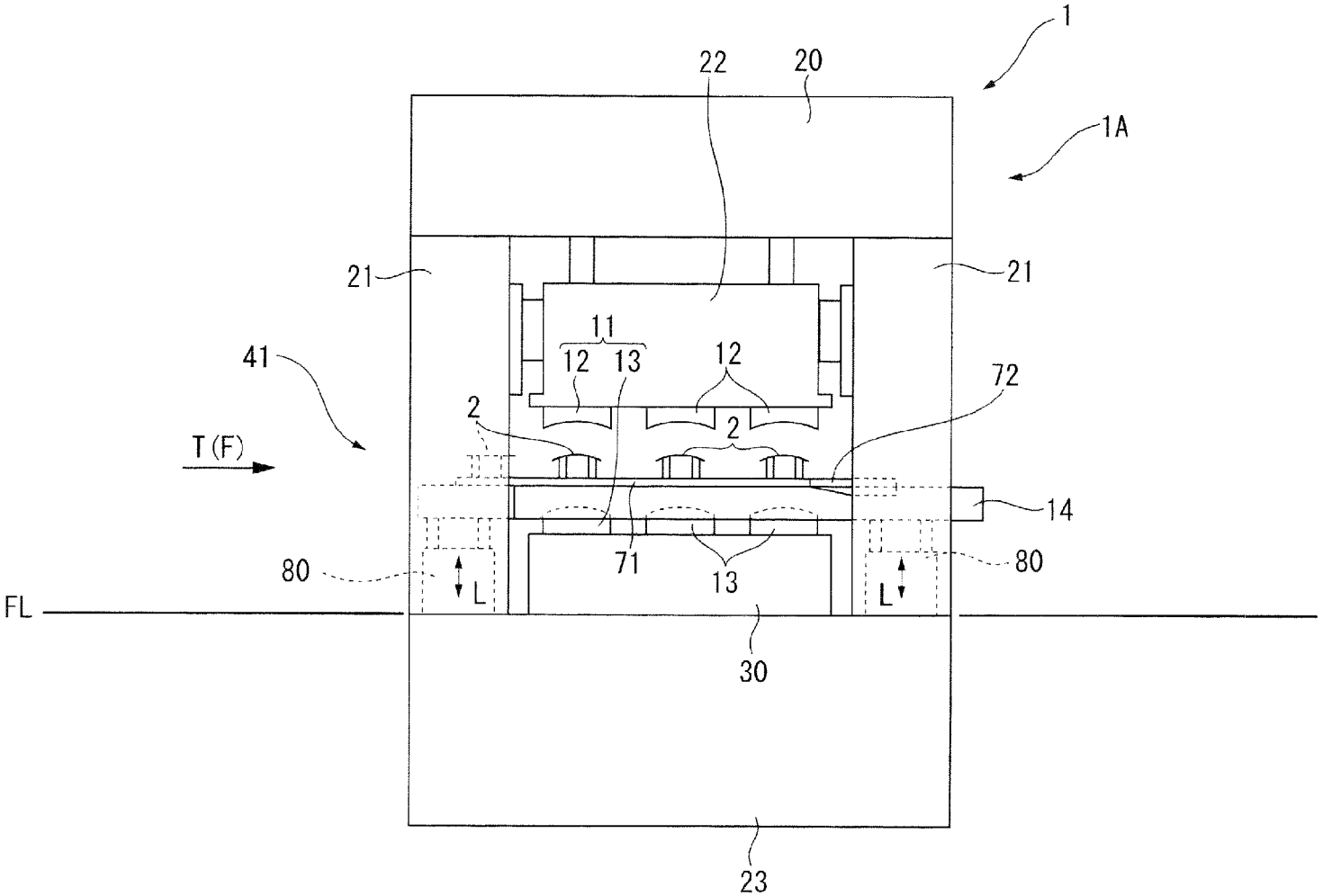
FIG. 1 is an overall view of a press machine of an embodiment of to the invention.

1: transfer press (press machine)
2: workpiece
14: bar
15: bar connecting device
16: air clamp (holding means)
41: transfer feeder (workpiece transfer device)
52: workpiece holder
70: feed driving mechanism
71: slide plate (slide member)
72: movable plate (movable member)
73: plate connecting portion (connecting portion)
75: feeding linear motor (feed driving source)
141: fixed bar
142: movable bar
151: fixed-side connecting portion
152: movable-side connecting portion
153A: guide pin
153B: guide hole
165: clamp member (holding member)
731: engaging portion
732: engaged portion

BEST MODE FOR CARRYING OUT THE INVENTION

An embodiment of the present invention will be described below with reference to the drawings.

FIG. 1 is an overall view of a transfer press (a press machine) 1 of the present embodiment of the invention. In FIG. 1, the transfer press 1 includes: a press main body 1A having a bed 23, an upright 21, a crown 20 and a slide 22; a die 11 having an upper die 12 and a lower die 13; a moving bolster 30; and a transfer feeder (a workpiece transfer device) 41.

The bed 23 (a foundation) of the transfer press 1 is provided under a floor (FL). On a top surface of the bed 23, a plurality of uprights 21 (four in total in the embodiment, only two of the uprights are shown in FIG. 1) stand so as to face each other in a feed direction F (a direction parallel to a transfer direction T of a workpiece 2) and in a clamp direction (a direction horizontally orthogonal to the feed direction F i.e. a direction orthogonal to the sheet surface of FIG. 1). On the uprights 21, the crown 20 in which a slide driver (not shown) is provided is supported. Below the crown 20, the slide 22 that can be raised and lowered by the slide driver is suspended. On a bottom surface of the slide 22, a plurality of upper dies 12 usable in a plurality of steps in press-molding are aligned along the feed direction in a detachable manner. On the top surface of the bed 23, the moving bolster 30 is provided. On a top surface of the moving bolster 30, a plurality of lower dies 13 (which are respectively paired with to the upper dies 21) are provided in a detachable manner so as to face the respective upper dies 12.

The moving bolster 30 will be described in detail below.

The moving bolster 30 can be transferred to and from the top surface of the bed 23 to replace a used die 11 (the upper die 12, the lower die 13) with a new die 11.

A rail (not shown) is provided on the floor and the bed 23. The moving bolster 30 includes a driver to self-travel on the rail. When the moving bolster 30 self-travels owing to the driver, the moving bolster 30 moves in the clamp direction while passing between the pair of uprights 21 standing in parallel in the workpiece transfer direction T, thus being transferred into (or out of) the transfer press 1.

Note that the moving bolster 30 is generally prepared in two sets. A first set of the moving bolster 30 carrying the used die 11 is automatically exchanged with a second set of the moving bolster 30 carrying a to-be-next-used die 11 that is mounted thereon in advance outside the transfer press 1, thereby speedily exchange the dies 11 in accordance with a workpiece type.

Next, the transfer feeder 41 will be described in detail below.

Figure 2:
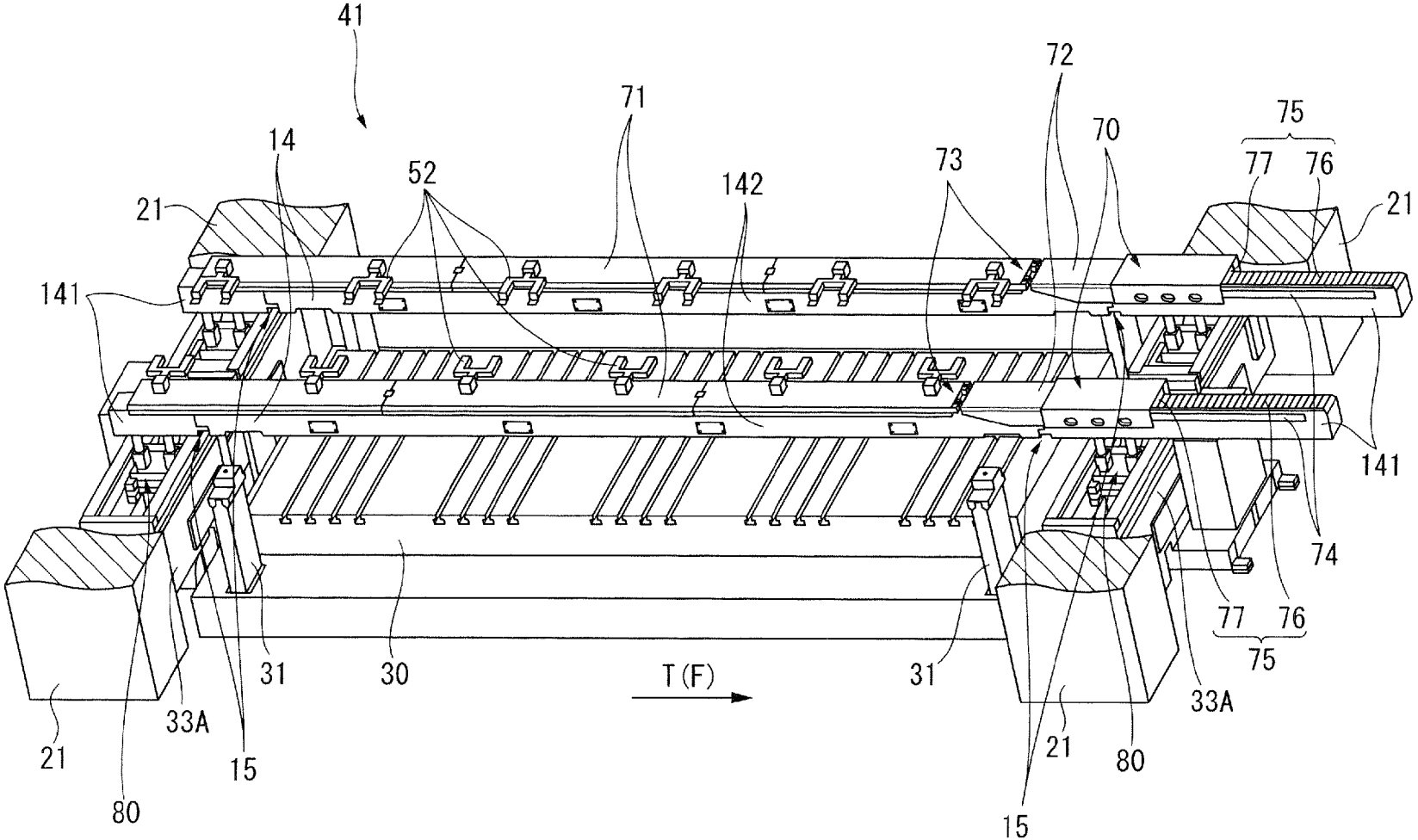
FIG. 2 is a perspective view showing a workpiece transfer device of the aforesaid embodiment of the invention.

FIG. 2 shows a perspective view of the transfer feeder 41. In FIG. 2, the transfer feeder 41 includes: a pair of bars 14 respectively disposed on the right and left of the workpiece transfer direction T (also referred to herein as bar assemblies); a workpiece holder 52 provided on each of the pair of bars 14 to hold the workpiece 2; a feed driving mechanism 70 that moves the workpiece holder 52 in the feed direction F; and a lift/clamp device (a bar driving mechanism) 80 that moves the pair of bars 14 in the clamp direction and an up-and-down direction (a direction orthogonal to the feed direction F and the clamp direction, i.e., a lift direction L, see FIG. 1).

The pair of bars 14 are positioned in parallel to the feed direction F with a predetermined distance from each other.

Frames 33A are respectively provided on the bed 23 at positions between the pairs of uprights 21 on both sides (upstream and downstream sides) of the workpiece transfer direction T in which the moving bolster 30 transfers the workpiece. The frames 33A each have the lift/clamp device 80.

The bars 14 each include: fixed bars 141 fixed on ends of the lift/clamp device 80; a movable bar 142 provided between the fixed bars 141 and detachable from the fixed bars 141 during the die exchange; and bar connecting devices 15 for connecting the fixed bars 141 and the movable bar 142.

Figure 3:
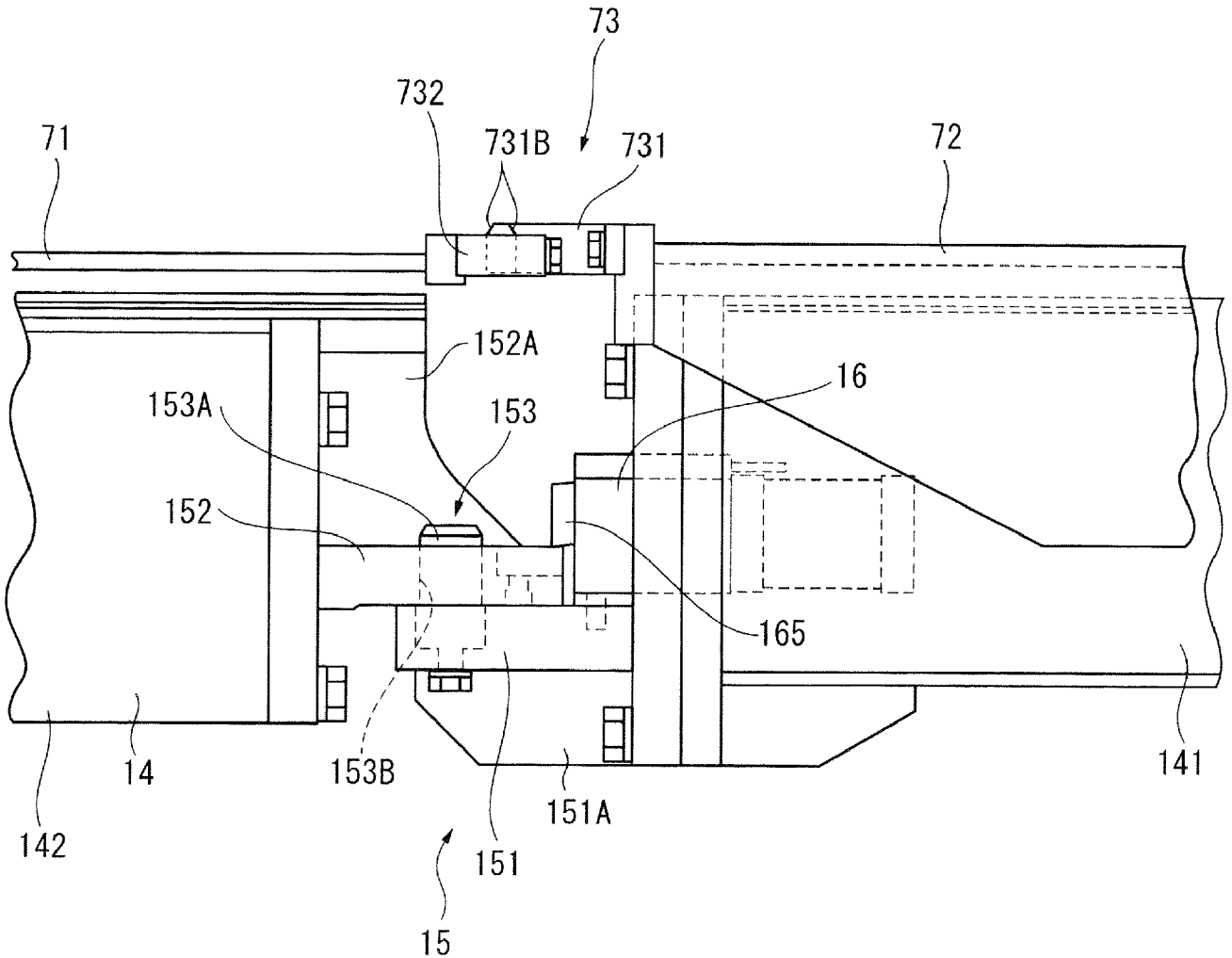
FIG. 3 is a side view showing a bar connecting device of the aforesaid embodiment of the invention.
Figure 4:
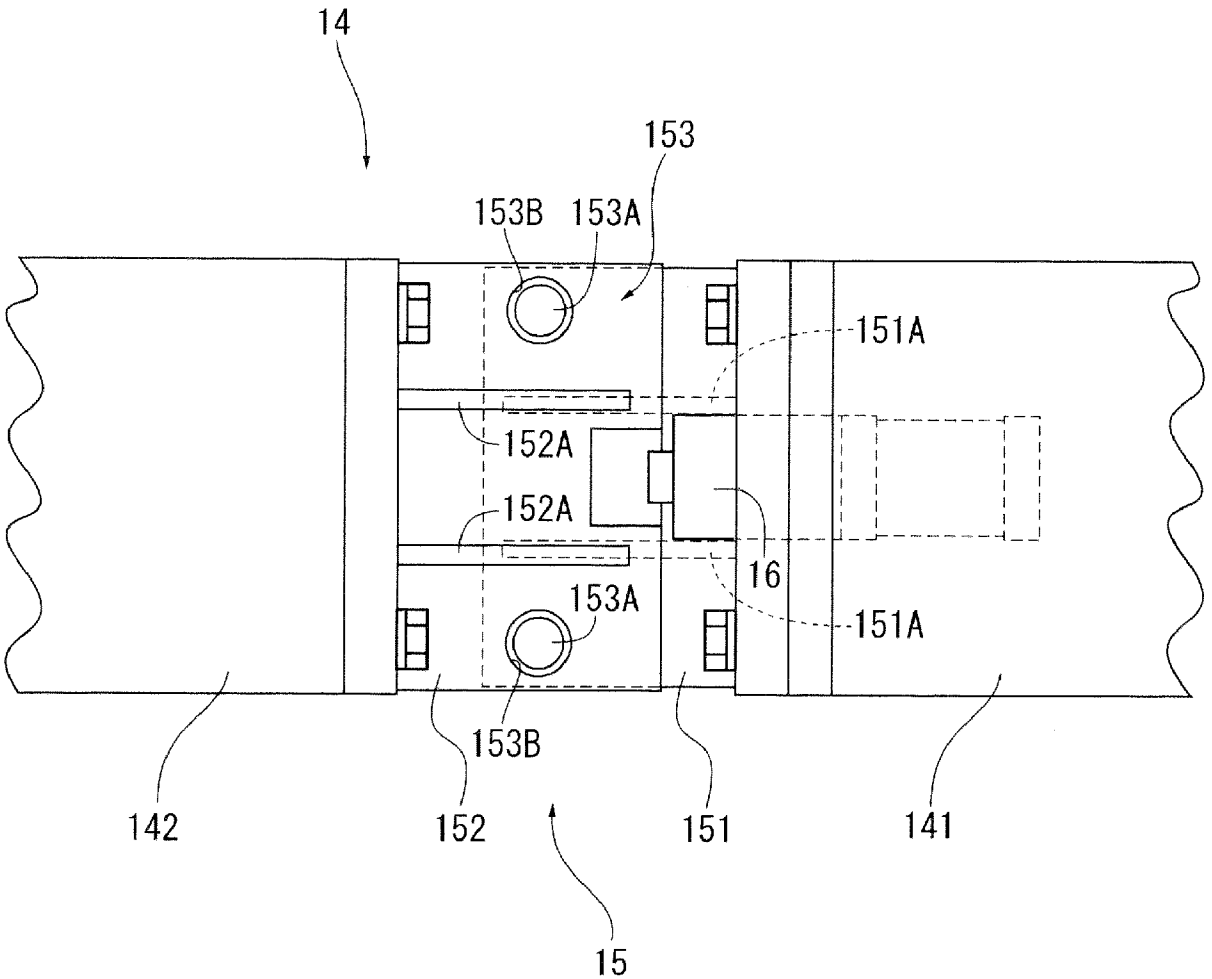
FIG. 4 is a partially-enlarged plan view of the bar connecting device of aforesaid embodiment of the invention.

FIGS. 3 and 4 show the bar connecting device 15. FIG. 3 is a side view of the bar connecting device 15. FIG. 14 is a plan view of the bar connecting device. FIG. 4 shows the bar 14 with the feed driving mechanism 70 removed when seen from an upper side.

The bar connecting devices 15 each include: a fixed-side connecting portion 151 provided on a side of the fixed bar 141; a movable-side connecting portion 152 provided on a side of the movable bar 142; a positioning mechanism 153 that positions the movable-side connecting portion 152 and the fixed-side connecting portion 151; an air clamp (a holding means) 16 that fixes the movable-side connecting portion 152 to the fixed-side connecting portion 151; and an air supplier (not shown) that supplies air to the air clamp 16.

The fixed-side connecting portion 151 projects from an end of the fixed bar 141 toward the movable bar 142 in a longitudinal direction of the bar 14. The fixed-side connecting portion 151 is formed in a plate-like shape and provided such that a plane thereof lies in a substantially horizontal direction. On a bottom surface of the fixed-side connecting portion 151, a fixed-side rib 151A is provided to reinforce the fixed-side connecting portion 151. The fixed-side ribs 151A are provided at a plurality of positions (two positions in this embodiment), each fixed-side rib 151A extending along the longitudinal direction of the bar 14 from the end of the fixed bar 141 to a position adjacent to an end of the fixed-side connecting portion 151. These fixed-side ribs 151A enhance the strength of the fixed-side connecting portion 151 in the lift direction L.

The movable-side connecting portion 152 projects from an end of the movable bar 142 toward the fixed bar 141 in the longitudinal direction of the bar 14. The movable-side connecting portion 152 is formed in a plate-like shape and provided such that a plane thereof lies in a substantially horizontal direction. On a top surface of the movable-side connecting portion 152, a movable-side rib 152A is provided to reinforce the movable-side connecting portion 152. The movable-side ribs 152A are provided at a plurality of positions (two positions in this embodiment), each movable-side rib 152A extending along the longitudinal direction of the bar 14 from the end of the movable bar 142 to a position adjacent to an end of the movable-side connecting portion 152. These movable-side ribs 152A enhance the strength of the movable-side connecting portion 152 in the lift direction L.

The positioning mechanism 153 includes a guide pin 153A provided on the fixed-side connecting portion 151 and a guide hole 153B formed in the movable-side connecting portion 152. The guide pins 153A are provided at two positions on outer sides of the fixed-side ribs 151A so as to be aligned in a direction orthogonal to the longitudinal direction of the bar 14, each guide pin 153A projecting from the fixed-side connecting portion 151 upward (i.e. toward the movable-side connecting portion 152). The guide holes 153B are formed in the movable-side connecting portion 152 at two positions corresponding to the positions of the guide pins 153A. The guide holes 153B are disposed on outer sides of the movable-side ribs 152A so as to be aligned in a direction orthogonal to the longitudinal direction of the bar 14.

In the thus-arranged positioning mechanism 153, by inserting the guide pins 153A in the guide holes 153B, the fixed-side connecting portion 151 and the movable-side connecting portion 152 are positioned in the feed direction F and the clamp direction. The positioning mechanism 153 (the guide pins 153A and the guide holes 153B) also functions to receive load in the clamp direction which is applied on the positioning mechanism 153 while the bar 14 is being moved in the clamp direction.

Figure 5:
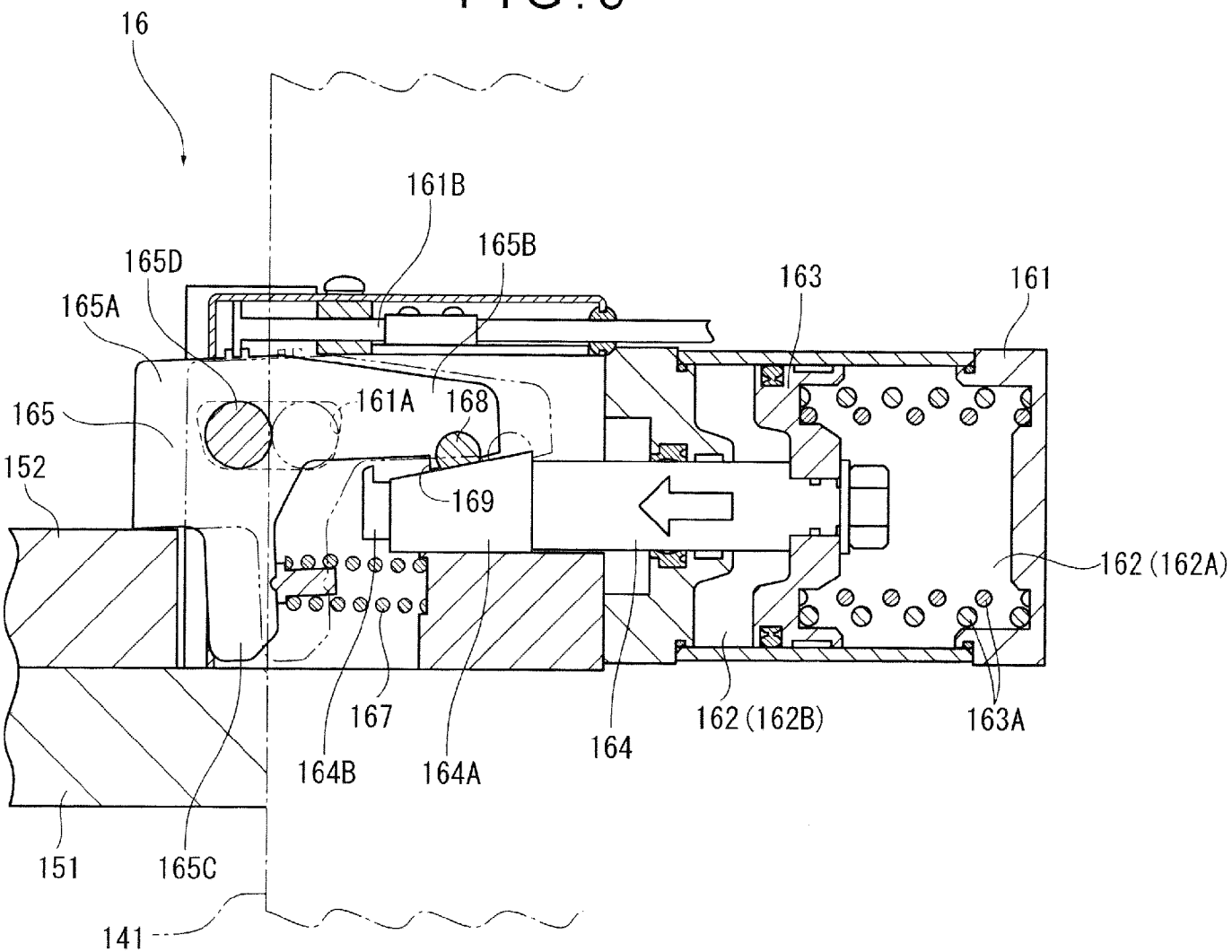
FIG. 5 is a side cross-sectional view of a holding means of the aforesaid embodiment of the invention.

FIG. 5 shows a side cross-sectional view of the air clamp 16. As shown in FIG. 5, the air clamp 16 may be driven by the air pressure to hold the movable-side connecting portion 152 against the fixed-side connecting portion 151. For example, an air-driven clamp Model TLA manufactured by Pascal Corporation is used in this embodiment. The air clamp 16 includes a case 161 accommodated in the fixed bar 141; an air supply chamber 162 provided in the case 161; a piston 163 disposed in the air supply chamber 162; a piston rod 164 advanceable and retractable in accordance with movement of the piston 163; and a clamp member (a holding member) 165 that clamps the movable-side connecting portion 152 in accordance with the advancement and retraction of the piston rod 164.

When seen in a cross-sectional direction of the fixed bar 141, the entire case 161 is accommodated in the fixed bar 141. In a longitudinal direction of the fixed bar 141, almost the entire case 161 is accommodated in the fixed bar 141 except for a part of the case 161 protruding from an end of the fixed bar 141. The thus-arranged case 161 is fixed to the fixed bar 141 using screws and the like. In the case 161, the air supply chamber 162 is provided on a side apart from the end of the fixed bar 141.

As described above, since the case 161 is accommodated in the fixed bar 141, the air clamp 16 does not greatly protrude from the end of the fixed bar 141. Hence, dimensions of the fixed-side connecting portion 151 and the movable-side connecting portion 152 in the longitudinal direction of the bar 14 can be short, thereby preventing reduction in strength of a connecting portion of the bar 14.

The air supply chamber 162 is partitioned into two divisions by the piston 163. In one division i.e. an air supply chamber 162A, a compression spring 163A is provided between the piston 163 and an inner wall of the case 161. The piston 163 can be biased by the compression spring 163A toward an air supply chamber 162B. The two air supply chambers 162 (162A, 162B) are connected with the air supplier, so that predetermined-pressure air can be supplied to the air supply chambers 162 (162A, 162B).

An end of the piston rod 164 is fixed to the piston 163. The piston rod 164 penetrates through the air supply chamber 162. A wedge-shaped member 164A is fixed to the other end of the piston rod 164 outside the air supply chamber 162. A hooked member 164B is provided on the other end of the piston rod 164 on a further distal side than the wedge-shaped member 164A.

A bottom surface of the wedge-shaped member 164A is slidable in an axial direction of the piston rod 164 relative to the case 161. A top surface of the wedge-shaped member 164A is a slant surface inclined toward the distal side of the piston rod 164 so as to reduce its dimension from the top surface to the lower surface, whereby the wedge-shaped member 164A is tapered as a whole toward the distal side. The hooked member 164B protrudes upward in a hook-like shape.

The clamp member 165 includes a clamp portion 165A that holds the movable-side connecting portion 152, an operating portion 165B that transfers the advancement and retraction of the piston rod 164 to the clamp member 165, a spring mounting portion 165C on which a spring 167 for biasing the clamp member 165 to the piston rod 164 is mounted. The clamp member 165 includes a rotary shaft 165D extending in a direction orthogonal to the advancement and retraction direction (the longitudinal direction of the bar 14), the rotary shaft 165D being inserted in an elongated hole 161A formed in the case 161 (as shown in the dotted line in FIG. 6). Note that since the major axis of the elongated hole 161A is aligned in the longitudinal direction of the fixed bar 141, the clamp member 165 is supported so as to be rotatable relative to the case 161 and slidable in the longitudinal direction of the bar 14.

The clamp portion 165A can protrude from the case 161. A bottom surface on the distal side of the clamp portion 165A can abut on the top surface of the movable-side connecting portion 152. The bottom surface of the clamp portion 165A may be flat to stably abut on the top surface of the movable-side connecting portion 152. When the clamp portion 165A abuts on the top surface of the movable-side connecting portion 152, the movable-side connecting portion 152 is sandwiched between the clamp portion 165A and the fixed-side connecting portion 151. Accordingly, the movable-side connecting portion 152 is fixed against the fixed-side connecting portion 151 in the lift direction L. Hence, the fixed-side connecting portion 151 and the clamp portion 165A function to receive load in the lift direction L which is applied thereon while the bar 14 is being moved in the lift direction L.

The operating portion 165B is provided with a follower 168 that abuts on the wedge-shaped member 164A and is rotatable relative to the operation portion 165B.

A step 169 is provided on the operation portion 165B at a position more adjacent to a distal end of the fixed bar 141 than the follower 168 and is engageable with the hooked member 164B of the piston rod 164.

The spring mounting portion 165C extends downward below the rotary shaft 165D in a direction substantially orthogonal to an extending direction of the operating portion 165B with the rotary shaft 165D as an intersection. On a surface of the spring mounting portion 165C on the opposite side of the end of the fixed bar 141, the spring 167 is mounted to be disposed between the surface and the case 161. The spring 167 biases the clamp member 165 in a rotational direction around the rotary shaft 165D, thereby pressing the follower 168 of the operating portion 165B to the wedge-shaped member 164A at a predetermined biasing force. The biasing force makes the follower 168 suitably follow the wedge-shaped member 164A in accordance with the movement of the piston rod 164, so that the clamp member 165 can be reliably moved.

The air clamp 16 is provided with a limit switch 161B for detecting excess movement of the clamp member 165.

In the air clamp 16, when air is supplied to the air supply chamber 162A, the air pressure as well as the biasing force from the compression spring 163A are applied on the piston 163, so that the piston 163 is moved to the air supply chamber 162B. The piston rod 164 is also moved in accordance with the movement of the piston 163 and the wedge-shaped member 164A is moved toward the distal side of the fixed bar 141. At this time, the follower 168 of the clamp member 165 rotates on the top surface of the wedge-shaped member 164A. However, since the thickness in the up-and-down direction of the wedge-shaped member 164A gradually increased, the clamp member 165 rotates around the rotary shaft 165D against the biasing force of the spring 167. The slant top surface of the wedge-shaped member 164A generates force that presses the clamp member 165 to the distal side in the longitudinal direction of the fixed bar 141 on the follower 168. The force slides the rotary shaft 165D relative to the elongated hole 161A of the case 161, thereby moving the clamp member 165. In other words, the clamp portion 165A is protruded from the case 161 and simultaneously rotated to move toward the fixed-side connecting portion 151.

By the rotation and the advancement and retraction, the clamp member 165 rotates downward while moving in the longitudinal direction of the bar 14 Accordingly, the clamp portion 165A abuts on the movable-side connecting portion 152 with a predetermined force to hold the movable-side connecting portion 152 against the fixed-side connecting portion 151.

Since the piston 163 is biased in advance at a predetermined biasing force by the compression spring 163A, a predetermined clamp force by the clamp member 165 can be obtained with small air pressure, thereby promoting power saving. In addition, since such an arrangement can realize a predetermined clamp force with small air pressure, an air-pressure clamp can be employed in place of a high-pressure hydraulic clamp of the related art, thereby simplifying the structure, control and operation of the bar connecting device 15.

Even when the air supply is stopped in failure, the movable-side connecting portion 152 can be held with the biasing force of the compression spring 163A, thereby reliably preventing a problem such as a release of the connection.

Further, since the clamp force is obtained by moving the piston 163 by the air pressure, the piston 163 can be moved more quickly as compared with an arrangement where the piston 163 is moved by hydraulic pressure, thereby reducing time required to exchange the die.

On the other hand, in order to release the movable-side connecting portion 152 from holding the air clamp 16, the air is supplied to the other air supply chamber 162B.

When the air is supplied to the air supply chamber 162B, the piston 163 is moved against the biasing force from the compression spring 163A toward the air supply chamber 162A. The piston rod 164 is moved in accordance with the movement of the piston 163, so that the wedge-shaped member 164A is evacuated. Accordingly, the clamp member 165 evacuates in accordance with the movement of the piston rod 164 while rotating around the rotary shaft 165D, so that the clamp portion 165A is accommodated in the case 161 (see the double-dotted line of the clamp member 165 in FIG. 5).

Returning to FIGS. 2 and 3, the feed driving mechanism 70 includes: a slide plate (a slide member) 71 on which a plurality of workpiece holders 52 are detachably provided; a movable plate 72 connected with the slide plate 71; a plate connecting portion (a connecting portion) 73 that connects the slide plate 71 to the movable plate 72 and separates the slide plate 71 from the movable plate 72; and a feeding linear motor (a feed driving source) 75 that is attached on the movable plate 72 to move the movable plate 72 and the slide plate 71 in the feed direction F.

The slide plate 71 is formed by a plurality of plate-like members connected to each other and covers a top surface of the movable bar 142. The plurality of workpiece holders 52 are attached on the slide plate 71 at substantially regular intervals such that each pair of workpiece holders 52 can hold the workpiece 2.

The movable plate 72 can be guided on the fixed bar 141 in the feed direction F by the guide rails 74 provided on lateral surfaces of the fixed bar 141.

Figure 6:
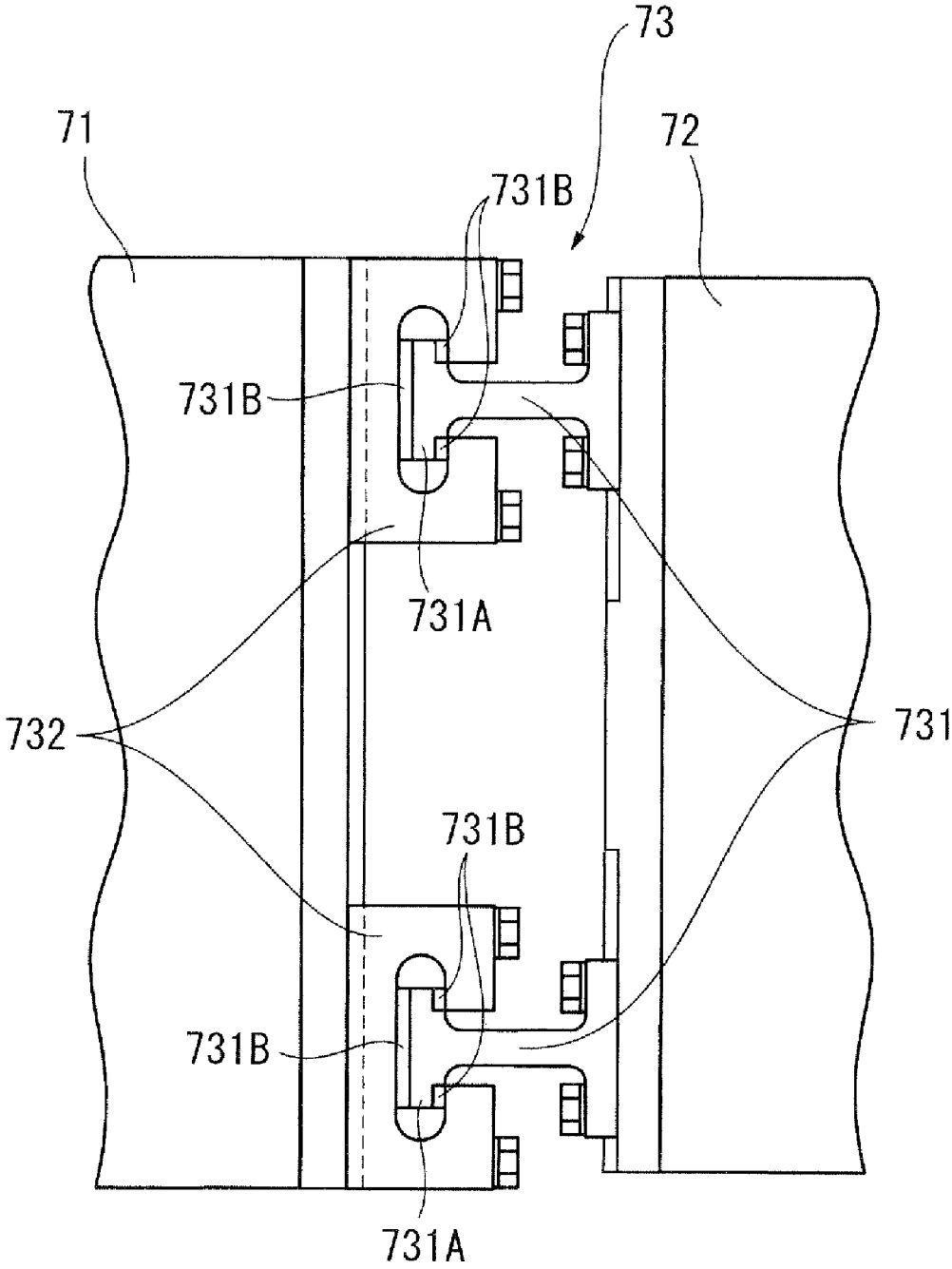
FIG. 6 is a plan view showing a connecting portion of the aforesaid embodiment of the invention.

FIG. 6 shows an enlarged plan view of the plate connecting portion 73. As shown in FIG. 6, the plate connecting portion 73 includes: an engaging portion 731 provided on an end of the movable plate 72; and an engaged portion 732 that is provided on an end of the slide plate 71 and engaged with the engaging portion 731.

Several engaging portions 731 are provided (two in this embodiment) on the end of the movable plate 72, each of the engaging portions 731 projecting toward the slide plate 71. The engaging portions 731 each have a substantially T-shape in plan view. The engaged portion 732 is engaged with a distal end 731A of the engaging portion 731. Slant portions 731B are respectively provided on an upper side in a thickness direction on a distal side and on a base side of the distal end 731A. The slant portions 731B guide the distal end 731A in the engaged portion 732 when the distal end 731A is moved upward to engage with the engaged portion 732, whereby the distal end 731A can easily engage with the engaged portion 732.

The engaged portions 732 are provided on the end of the slide plate 71 at positions corresponding to those of the engaging portions 731 and each have a substantially C-shape in plan view dented toward the movable plate 72. The distal end 731A of the engaging portion 731 is inserted in the up-and-down direction (the vertical direction) into the concave of the engaged portion 732, so that the engaging portion 731 engages with the engaged portion 732.

Note that between the engaging portion 731 and the engaged portion 732, a predetermined gap (play) may be provided so as to facilitate the engagement. The gap may be set within a range where displacement in relative positions of the pair of workpiece holders 52 will not affect on holding performance of the workpiece 2.

Owing to the thus-arranged plate connecting portion 73, when the movable plate 72 and the slide plate 71 are relatively moved in the up-and-down direction (the thickness direction, the vertical direction), the engaging portion 731 engages with or disengages from the engaged portion 732.

Since the slide plate 71 and the movable plate 72 are slidable on the top surface of the movable bar 142 and an top surface of the fixed bar 141 respectively, when the movable plate 72 is driven by the feed linear motor 75 with the plate connecting portion 73 connected, the slide plate 71 and the movable plate 72 slide on the bar 14 in the feed direction F. Note that since the positions in the up-and-down direction of the slide plate 71 and the movable plate 72 are determined and guided by the top surface of the bar 14, the positions in the up-and-down direction of the engaging portion 731 and the engaged portion 732 of the plate connecting portion 73 will not be misaligned, thereby preventing disengagement of the slide plate 71 and the movable plate 72.

Since the plate connecting portion 73 includes the engaging portion 731 and the engaged portion 732; and the slide plate 71 and the movable plate 72 can be connected only by engaging the engaging portion 731 with the engaged portion 732, it is unnecessary to use an actuator or the like as the plate connecting portion 73, thereby simplifying the structure of the plate connecting portion 73 and preventing operation failure of the actuator. In addition, since the structure of the plate connecting portion 73 can be simplified, the total number of components of the plate connecting portion 73 can be reduced, thereby promoting downsizing and weight-reducing of the plate connecting portion 73. Further, since the actuator or the like is not required, operation checking of the actuator or the like can be omitted, whereby die exchange time can be shortened and maintenance efficiency can be improved.

The feed linear motor 75 includes: a magnet plate 76 (a fixing portion) laid on the top surface of the fixing bar 141 in the feed direction F; and a coil plate 77 (a movable portion) provided so as to face the magnet plate 76 and fixed on a bottom surface of the movable plate 72. When a current is given to the coil plate 77 such that shifting magnetic field is generated on the coil plate 77, the coil plate 77 is moved by attraction and repulsion of the magnet plate 76. When the movable plate 72 is moved together with the coil plate 77, the slide plate 71 is moved in accordance with the movement of the movable plate 72 on the movable bar 142 in the feed direction F. Accordingly, the plurality of workpiece holders 52 attached on the slide plate 71 are concurrently moved in the feed direction F while the distances between the workpiece holders 52 are maintained.

As described above, since the plurality of workpiece holders 52 are detachably provided on the slide plate 71 and the slide plate 71 is driven by the feed linear motor 75, the plurality of workpiece holders 52 can be moved by the feed linear motor 75 (or two feed linear motors 75) per one bar 14. Hence, the number of the feed linear motors 75 can be decreased, thereby reducing the costs of the transfer feeder 41.

Note that when two feed linear motors 75 are provided, the feed linear motors 75 are respectively provided on both fixed bars 141 on both sides of the movable bars 142. Note that when a single feed linear motor 75 is provided, the feed linear motor 75 is provided on either one of the fixed bars 141 on both sides of the movable bars 142.

Note that the position of the magnet plate 76 relative to the fixed bar 141 may not be on the top surface of the fixed bar 141 but may be laid along a lateral surface or a bottom surface of the fixed bar 141.

Further, in the description above, the magnet plate and the coil plate of the linear motor are respectively provided on a fixed side and a movable side. However, the magnet plate may be provided on the movable side and the coil plate may be provided on the fixed side.

Although not shown in detail in the figures, the lift/clamp device 80 includes a lift device that moves the bars 14 in the lift direction L and a clamp device that moves the bars 14 in the clamp direction.

The lift device moves (lifts) the bar 14 up and down by rotating a screw with a lift driving motor. The clamp device moves the bars 14 in the clamp direction by rotating a screw with a clamp driving motor. Note that in the movement in the clamp direction, the pair of bars 14 moves in opposite directions. Specifically, the pair of bars 14 moves in a direction toward each other or apart from each other.

Next, operations of the thus-arranged transfer press 1 will be described below.

In order to transfer the workpiece 2, the transfer feeder 41 performs a three-dimensional movement including: a feed/return movement in which the workpiece holder 52 is reciprocated by the feed linear motor 75 in the workpiece transfer direction T on the bar 14; a raising/lowering movement (a lifting up/down movement) in which the bar 14 is raised/lowered (lifted up/down) by the lift/clamp device 80; and a clamp/unclamp movement in which the bar 14 is reciprocated by the lift/clamp device 80 in a direction vertically-orthogonal to the workpiece transfer direction T. By properly reciprocating the workpiece holder 52 in the feed direction F, the lift direction L and the clamp direction, the workpiece 2 is sequentially transferred from a lower die 13 on the upstream (the left side in FIG. 1) to a lower die 13 on the downstream (the right side in FIG. 1).

Since the workpiece holder 52 needs to be replaced with a new workpiece holder 52 suitable for the new die when the die 11 is replaced with a new die, the workpiece holder 52 and the bar 14 are placed on the moving bolster 30 to be transferred from a workpiece transfer region to the outside. Note that the bar 14 is supported by the lift/clamp device 80 provided on the frame 33A, which hinders carrying-out of the bar 14.

Hence, the movable bar 142 of the bar 14 is separated and detached from the fixed bar 141 and the movable bar 142 is placed on the bar receiving table 31 of the moving bolster 30. At this time, since the slide plate 71 needs to be detached as well as the movable bar 142, the slide plate 71 is detached from the movable plate 72.

How to detach the bar 14 will be described below.

Detaching of the bar 14 includes: a positioning process for positioning the plate connecting portion 73 above the bar connecting device 15; a holding-releasing process for releasing the holding of the movable bar 142 by the fixed bar 141; an engagement-releasing process for releasing engagement between the fixed bar 141 and the movable bar 142 and engagement between the slide plate 71 and the movable plate 72 by moving the fixed bar 141 downward relative to the movable bar 142; and a movable-plate-evacuating process for evacuating the movable plate 72 in a direction apart from the slide plate 71.

Figure 7:
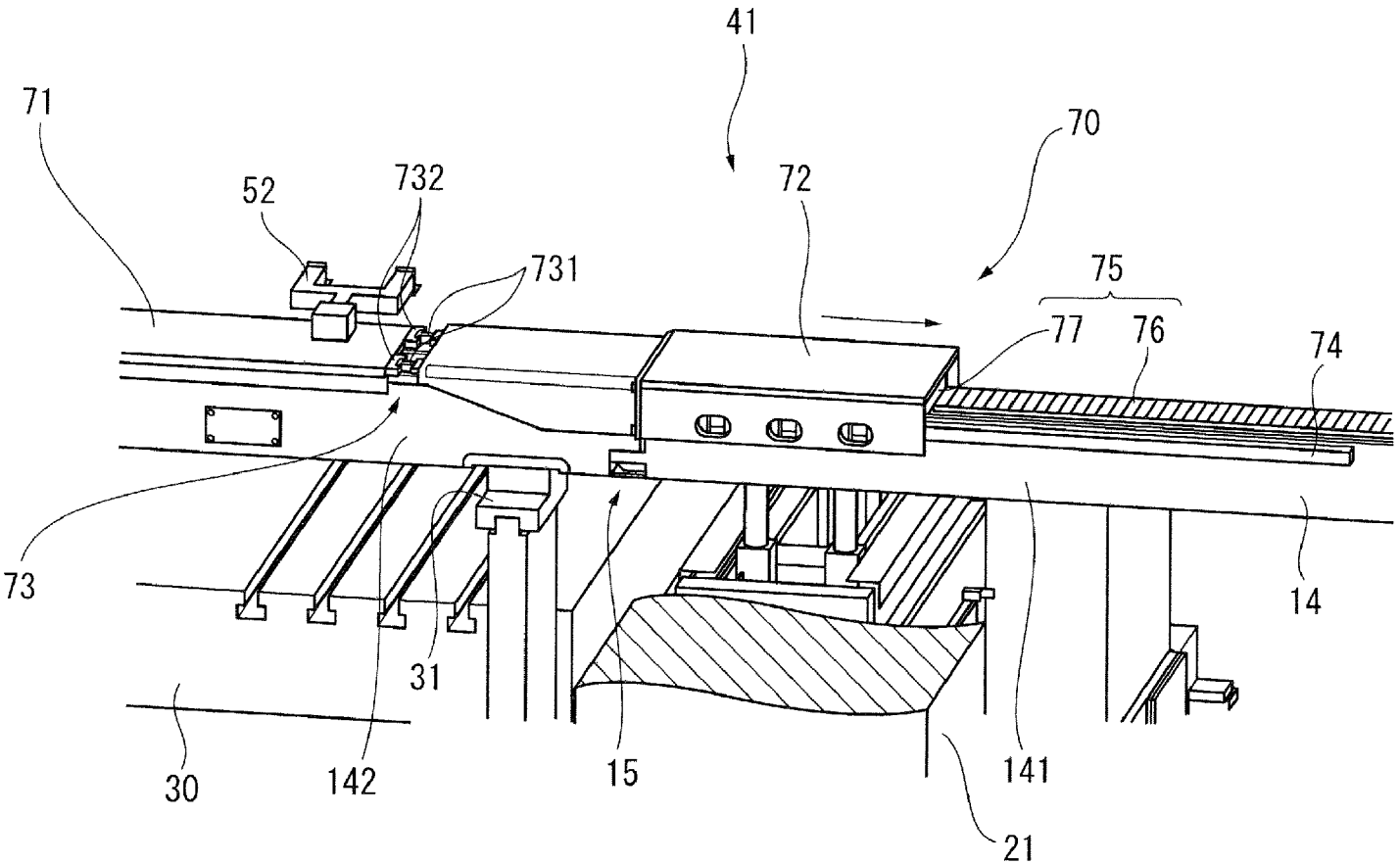
FIG. 7 is an illustration showing how a bar of the workpiece transfer device is detached in the aforesaid embodiment of the invention.
Figure 8:
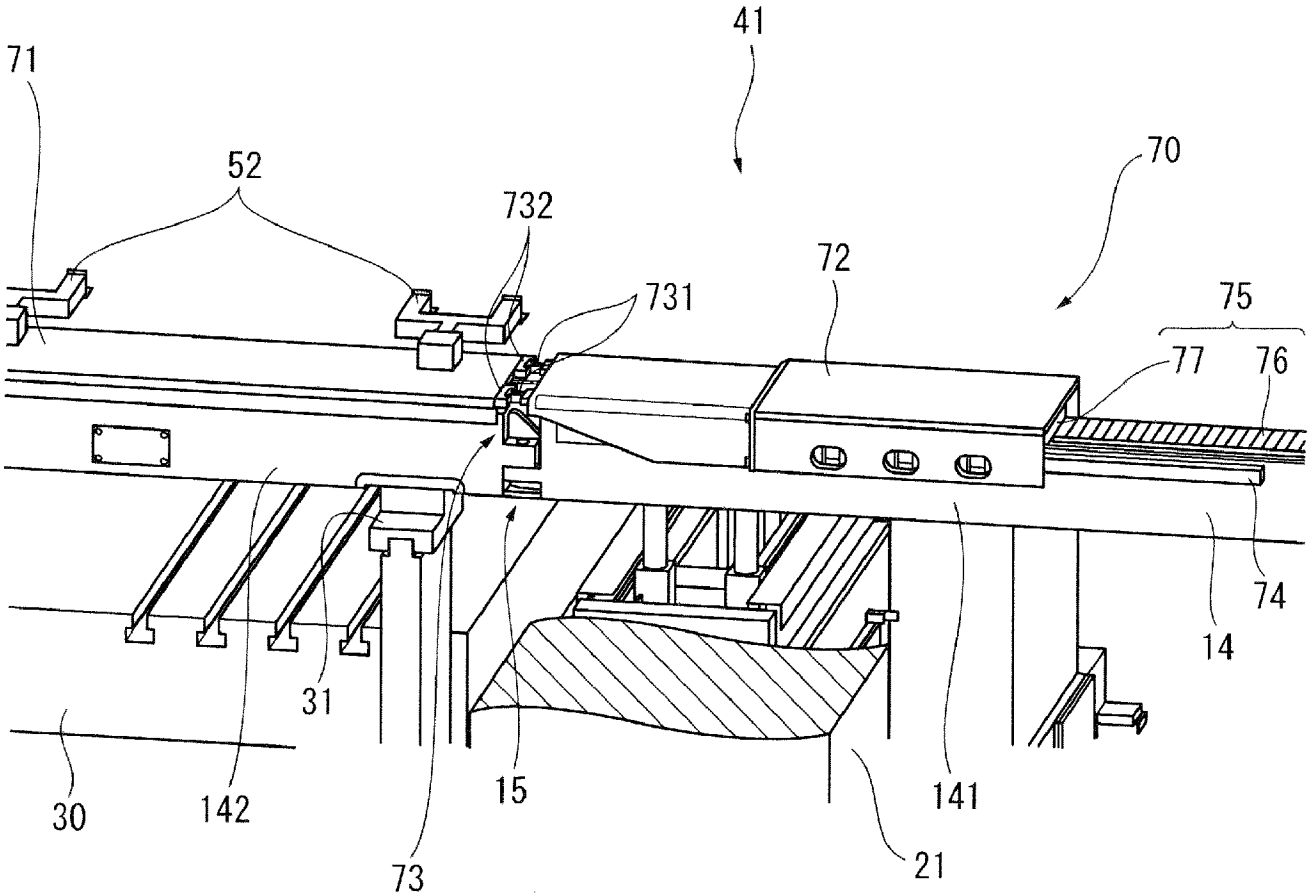
FIG. 8 is an illustration showing how the bar of the workpiece transfer device is detached in the aforesaid embodiment of the invention.

FIGS. 7 and 8 show the positioning process. In the positioning process, as shown in FIG. 7, the lift/clamp device 80 places the bar 14 on the bar receiving table 31. In this state, since the workpiece holder 52 has been used to transfer the workpiece 2, the movable plate 72 and the slide plate 71 are located at predetermined positions and the plate connecting portion 73 is displaced from the bar connecting device 15. Accordingly, the movable plate 72 and the slide plate 71 are slid by the feed linear motor 75 in the feed direction F, whereby moving the plate connecting portion 73 is moved from a position shown in FIG. 7 to a position shown in FIG. 8 which coincides with the position of the bar connecting device 15. By the positioning process, the plate connecting portion 73 is disposed above the bar connecting device 15.

Next in the holding-releasing process, air is supplied to the air supply chamber 162B of the air clamp 16 to rotate and evacuate the clamp member 165. At this time, the clamp member 165 is accommodated in the case 161, so that the clamp member 165 will not protrude above the movable-side connecting portion 152. By the holding-releasing process, the movable-side connecting portion 152 is released from holding by the fixed-side connecting portion 151 and by the clamp member 165, so that the bar connecting device 15 is free in the up-and-down direction.

Figure 9:
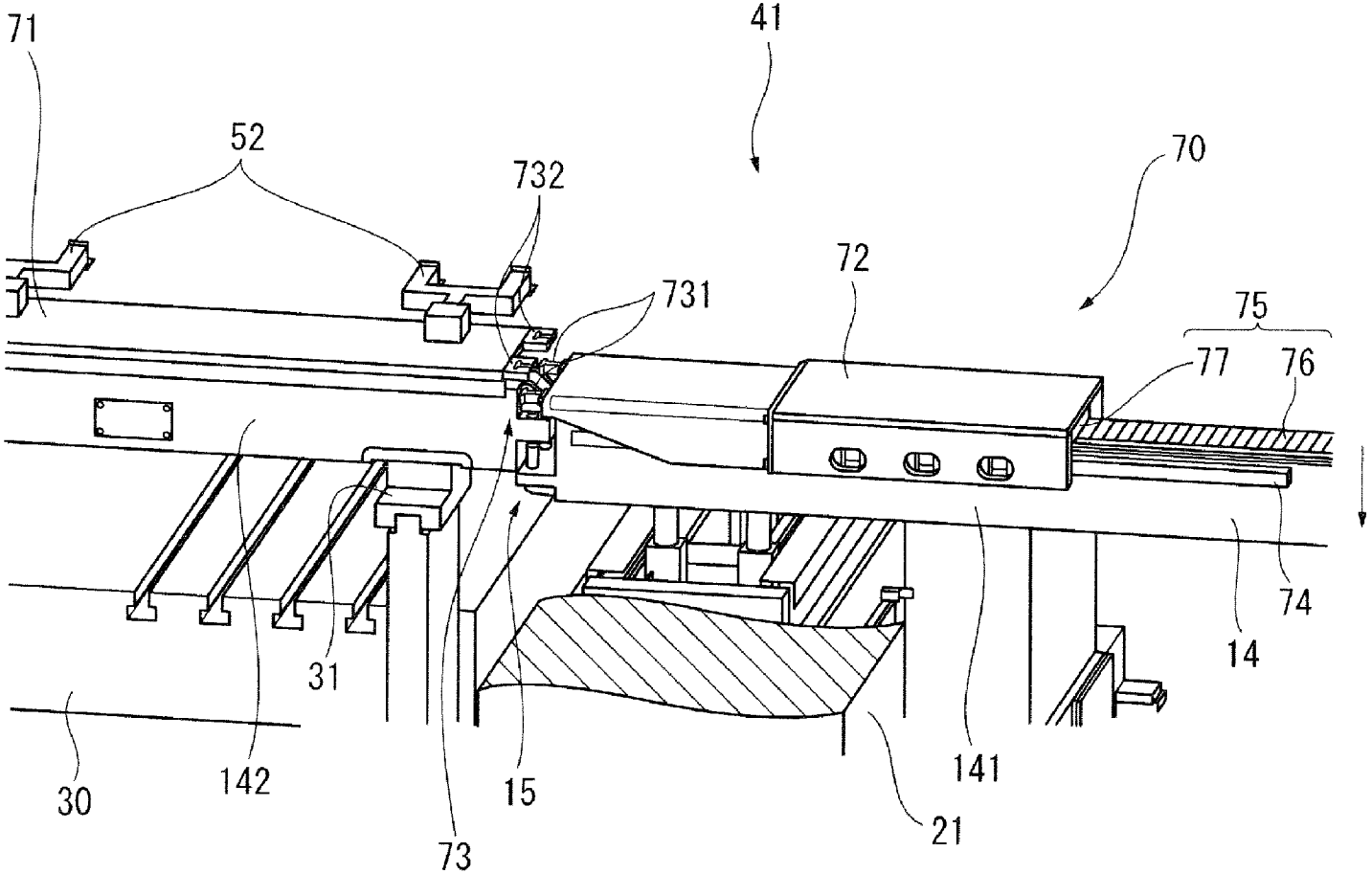
FIG. 9 is an illustration showing how the bar of the workpiece transfer device is detached in the aforesaid embodiment of the invention.

In the connection-releasing process, as shown in FIG. 9, the lift/clamp device 80 moves the bar 141 downward. Accordingly, the guide pin 153A disengages from the guide hole 153B, so that the connection of the bar connecting device 15 is released, thereby disengaging the movable bar 142 from the fixed bar 141. Simultaneously, since the engaging portion 731 is moved downward, the engagement of the engaging portion 731 and the engaged portion 732 is released, thereby releasing the connection between the slide plate 71 and the movable plate 72. Note that the holding-releasing process and the connection-releasing process are included in a connection-releasing process according to the invention.

Thus, by the positioning process and the connection-releasing process, the bar connecting device 15 and the plate connecting portion 73 can be simultaneously detached. Specifically, since both of the projecting direction of the guide pin 153A and the engaging direction of the engaging direction of the engaging portion 731 are vertical, when the guide pin is moved downward relative to the movable bar 142 in order to disengage the guide pin 153A from the guide hole 153B, this movement makes the engaging portion 731 move downward relative to the engaged portion 732, thereby releasing the engagement of the engaging portion 731. Hence, the bar 14 can be easily detached by a single operation, thereby simplifying the detachment of the bar 14.

Figure 10:
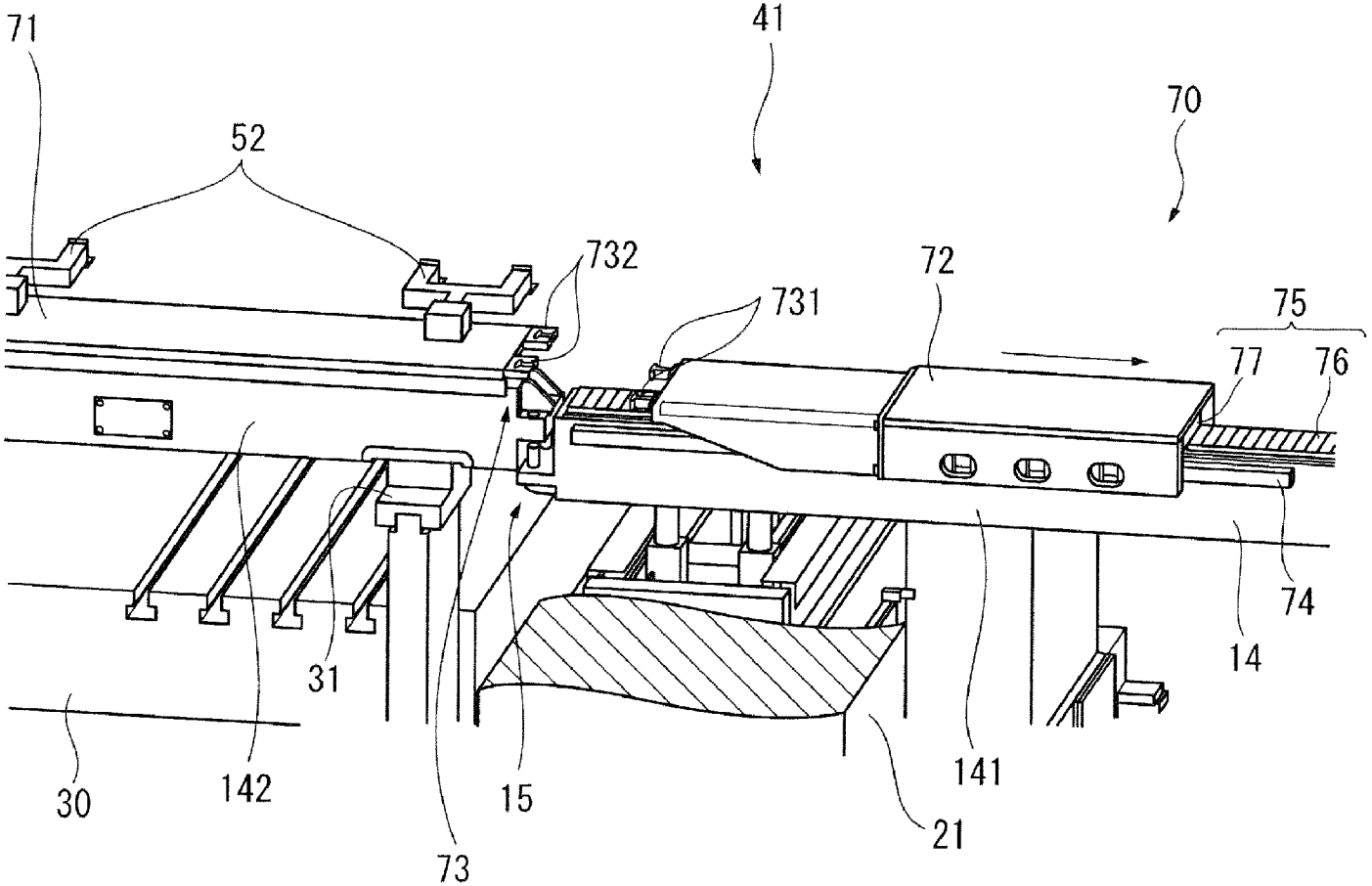
FIG. 10 is an illustration showing how the bar of the workpiece transfer device is detached in the aforesaid embodiment of the invention.

In the movable-plate-evacuating process, as shown in FIG. 10, the feed linear motor 75 is driven to further move the movable plate 72 in the feed direction F such that the movable plate 72 is spaced from the slide plate 71. Accordingly, the engaging portion 731 is evacuated to a position so as not to interfere with the engaged portion 732 or the movable bar 142.

Then, the moving bolster 30 is moved in a right and left direction (a direction orthogonal to the workpiece transfer direction T) of the transfer press 1 such that the movable bar 142 and with the moving bolster 30 are carried to the outside of the transfer press 1 (carrying-out process). In order to attach the bar 14 on which a to-be-next-used workpiece holder 52 is attached to the transfer feeder 41, reverse procedure to the above-described detaching process of the bar 14 is conducted. The attaching process of the bar 14 includes: a movable-bar-moving process, an engaging process and a movable-bar-holding process. In the movable-bar-moving process, the movable bar 142 to be used in the next pressing is placed on the bar receiving table 31 outside the transfer press 1 and then the moving bolster 30 is moved to carry the movable bar 142 into the transfer press 1. Subsequently, the moving bolster 30 is placed at a predetermined position on the bed 23 such that: the fixed-side connecting portion 151 is positioned below the movable-side connecting portion 152; the guide pin 153A is positioned below the guide hole 153B; and the engaging portion 731 is positioned below the engaged portion 732.

In the engaging process, the lift/clamp device 80 moves the fixed bar 141 upward such that the guide pin 153A is inserted in the guide hole 153B, thereby engaging the bar connecting device 15. Simultaneously with this engagement, the engaging portion 731 engages with the engaged portion 732, thereby establishing a connection of the plate connecting portion 73. Note that the positions in the up-and-down direction of the fixed bar 141 and the movable bar 142 are determined by abutting of the fixed-side connecting portion 151 on the movable-side connecting portion 152. Hence, the positions in the up-and-down direction of the engaging portion 731 and the engaged portion 732 are also accordingly determined, so that the slide plate 71 and the movable plate 72 are suitably positioned in the up-and-down direction.

Herein, when the guide pin 153A is inserted in the guide hole 153B, the bottom surface of the movable-side connecting portion 152 contacts the top surface of the fixed-side connecting portion 151. Thus, the movable-side connecting portion 152 is disposed on the fixed-side connecting portion 151. Hence, for example, even when the fixed bar 141 is excessively moved upward, the movable bar 142 will receive no load although the movable bar 142 is located above the bar receiving table, thereby preventing the bar 14 from being damaged. Accordingly, since it is unnecessary to ensure high accuracy in movement amount of the fixed bar 141, the position control of the fixed bar 141 can be simplified while the top surface of the fixed-side connecting portion 151 can be reliably brought into contact with the bottom surface of the movable-side connecting portion 152, whereby positioning of the fixed bar 141 and the movable bar 142 in the lift direction L can be facilitated.

In the movable-bar-holding process, air is supplied to the air supply chamber 162A of the air clamp 16 to move the piston 163 toward the end of the fixed bar 141. Then, the clamp member 165 protrudes from the case 161 and rotates around the rotary shaft 165D to move the clamp portion 165A downward, whereby the movable-side connecting portion 152 is held between the clamp portion 165A and the fixed-side connecting portion 151.

Note that the engaging process and the movable-bar-holding process are included in a connection process.

By an attaching process described above, the movable bar 142 is attached to the fixed bar 141 and the slide plate 71 is connected with the movable plate 72.

Note that the bar receiving table 31 may be provided with a lifting device or a means for moving the movable bar 142 in the clamp direction. In such an arrangement, when the die 11 is placed on the moving bolster 30 in the die exchange conducted outside the main body of the transfer press 1, the distance between the bars 14 can be widened, thereby facilitating the exchange of the die 11.

Note that the present invention is not limited to the aforesaid embodiment but also includes modifications, improvements and the like as long as an object of the invention can be achieved.

The engagement direction of the engaging portion and the engaged portion is not limited to the vertical direction but may be any direction such as a horizontal direction. For instance, when the engaging portion and the engaged portion are engaged in a horizontal direction, the engagement therebetween can be released by moving the fixed bar in the horizontal direction (the clamp direction) relative to the movable bar.

In the aforesaid embodiment, the engaging portion is attached on the movable member and the engaged portion is attached on the slide member. However, the arrangement is not limited thereto and the engaging portion may be attached on the slide member while the engaged portion may be attached on the movable member. In other words, it is only necessary that either of the slide member or the movable member is provided with the engaging portion and the other is provided with the engaged portion. The number of the engaging portion and the engaged portion and the positions thereof are not limited to two and the above-described positions but any number of the engaging portion and the engaged portion may be provided at any positions.

The shapes of the engaging portion and the engaged portion are not limited to the substantially T- and C-shapes but may be any shape as long as the engagement therebetween can be achieved. For example, the engaging portion and the engaged portion may have hook-like shapes engageable with each other. Alternatively, the engaging potion may be a pin and the engaged portion may be a hole into which the engaging portion is inserted.

The bar driving mechanism is not limited to the one that drives the bar in the lift direction and the clamp direction but the bar driving mechanism may drive the bar only in either of the lift direction L or the clamp direction.

The feed driving source is not limited to the linear motor but may be any type such as an electric motor.

The best arrangement, implementation and the like for embodying the present invention have been disclosed above, but the invention is not limited thereto. In other words, although the present invention is illustrated and described by exemplifying the particular embodiment, a person skilled in the art can add various modifications in shape, material, quantity and other detail arrangements to the aforesaid embodiment without departing from the technical idea and the scope of the invention.

Hence, in the above disclosure, the description limiting the shapes, materials and the like is intended to facilitate the understanding of the invention but is not for restricting the scope of the invention. Therefore, description using the names of the components without a part of or all of the limitation in the shapes, materials and the like is also included in the invention.

INDUSTRIAL APPLICABILITY

The present invention is applicable to a transfer press that performs a plurality of press processes with a single machine and sequentially transfers a workpiece to a subsequent process and to a series-connected tandem press.

The invention claimed is:

1. A workpiece transfer device of a press machine, comprising:

a pair of bar assemblies that are disposed substantially in parallel to a workpiece transfer direction;

a workpiece holder that holds a workpiece;

a respective feed driving mechanism that moves the workpiece holder in the workpiece transfer direction relative to and along each of the pair of bar assemblies; and a respective bar driving mechanism that drives each of the pair of bar assemblies at least either in a lift direction or in a clamp direction, wherein each of the bar assemblies includes a fixed bar that is fixed on the respective bar driving mechanism, a movable bar that is separable from the fixed bar and a bar connecting device that connects the fixed bar and the movable bar, the fixed bar and movable bar of each bar assembly being substantally parallel to the work transfer direction, wherein each feed driving mechanism includes a slide member that is supported by and slidable along the movable bar of the respective bar assembly, a movable member that is supported by and slidable along the fixed bar of the respective bar assembly, a connecting portion that connects the slide member and the movable member, and a feed driving source that is provided on the fixed bar and moves the movable member along the fixed bar in the workpiece transfer direction, the workpiece holder being provided in connection with the slide member, and wherein the connecting portion of each feed driving mechanism includes an engaging portion that is provided to one of the slide member and the movable member, and an engaged portion that is provided to the other of the slide member and the movable member and engageable with the engaging portion, and the engaging portion is engagable with the engaged portion in a direction substantially orthogonal to a longitudinal direction of the pair of bar assemblies.

2. The workpiece transfer device of the press machine according to claim 1, wherein the engaging portion is engagable with the engaged portion in a vertical direction.

3. The workpiece transfer device of the press machine according to claim 1, wherein the engaging portion is formed in a substantially T-shape in plan view, and the engaged portion is formed in a substantially C-shape in plan view.

4. The workpiece transfer device of the press machine according to claim 1, wherein each bar assembly further includes an additional fixed bar, and in each bar assembly, the fixed bars are provided on ends of the movable bar, and the feed driving source is provided to at least one of the fixed bars.

5. The workpiece transfer device of the press machine according to claim 1, wherein the bar connecting device of each bar assembly includes:

a fixed-side connecting portion that protrudes from an end of the fixed bar toward the movable bar;

a movable-side connecting portion that protrudes from an end of the movable bar toward the fixed bar to overlap with the fixed-side connecting portion; and holding means disposed in the fixed bar for holding the movable-side connecting portion against the fixed-side connecting portion by a holding member being advanced and retracted in a longitudinal direction of the fixed bar by air pressure.

6. The workpiece transfer device of the press machine according to claim 5, wherein one of the fixed-side connecting portion and the movable-side connecting portion is provided with a guide pin projecting toward the other of the fixed-side connecting portion and the movable-side connecting portion, and the other of the fixed-side connecting portion and the movable-side connecting portion is provided with a guide hole in which the guide pin is inserted.

7. The workpiece transfer device of the press machine according to claim 5, wherein each bar driving mechanism moves the respective fixed bar in the direction substantially orthogonal to the longitudinal direction of the pair of bar assemblies relative to the respective movable bar such that the fixed-side connecting portion and the movable-side connecting portion are overlapped with each other or spaced from each other while the connecting portion engages with or disengages from the connecting portion.

8. The workpiece transfer device of the press machine according to claim 1, wherein each bar assembly further includes an additional fixed bar, and the movable bar of each bar assembly is arranged between the fixed bars.

9. The workpiece transfer device of the press machine according to claim 8, wherein both fixed bars of the bar assemblies are fixed to the bar driving mechanisms.

10. A press machine comprising:

a workpiece transfer device of a press machine, wherein the workpiece transfer device includes:

a pair of bar assemblies that are disposed substantially in parallel to a workpiece transfer direction;

a workpiece holder that holds a workpiece;

a respective feed driving mechanism that moves the workpiece holder in the workpiece transfer direction relative to and along each of the pair of bar assemblies; and a respective bar driving mechanism that drives each of the pair of bar assemblies at least either in a lift direction or in a clamp direction, wherein the pair of bar assemblies each include:

a fixed bar that is fixed on the respective bar driving mechanism, a movable bar that is separable from the fixed bar; and a bar connecting device that connects the fixed bar and the movable bar, the fixed bar and movable bar of each bar assembly being substantially parallel to the work transfer direction, wherein each feed driving mechanism includes:

a slide member that is supported by and slidable along the movable bar of the respective bar assembly, the workpiece holder being provided in connection with the slide member;

a movable member that is supported by and slidable along the fixed bar of the respective bar assembly;

a connecting portion that connects the slide member and the movable member; and a feed driving source that is provided on the fixed bar and moves the movable member along the fixed bar in the workpiece transfer direction, and wherein the connecting portion of each feed driving mechanism includes:

an engaging portion that is provided to one of the slide member and the movable member; and an engaged portion that is provided to the other of the slide member and the movable member and engageable with the engaging portion, and the engaging portion is engagable with the engaged portion in a direction substantially orthogonal to a longitudinal direction of the pair of bar assemblies.

11. The press machine according to claim 10, wherein each bar assembly further includes an additional fixed bar, and the movable bar of each bar assembly is arranged between the fixed bars.

12. The press machine according to claim 11, wherein both fixed bars of the bar assemblies are fixed to the bar driving mechanisms.

13. A press machine comprising:

a workpiece transfer device of a press machine wherein the workpiece transfer device includes:

a pair of bar assemblies that are disposed substantially in parallel to a workpiece transfer direction;

a workpiece holder that holds a workpiece;

a respective feed driving mechanism that moves the workpiece holder in the workpiece transfer direction relative to and along each of the pair of bar assemblies; and a respective bar driving mechanism that drives each of the pair of bar assemblies at least either in a lift direction or in a clamp direction, wherein the pair of bar assemblies each include:

a fixed bar that is fixed on the respective bar driving mechanism, a movable bar that is separable from the fixed bar; and a bar connecting device that connects the fixed bar and the movable bar, the fixed bar and movable bar of each bar assembly being substantially parallel to the work transfer direction, wherein each feed driving mechanism includes:

a slide member that is supported by and slidable along the movable bar of the respective bar assembly, the workpiece holder being provided in connection with the slide member;

a movable member that is supported by and slidable along the fixed bar of the respective bar assembly;

a connecting portion that connects the slide member and the movable member; and a feed driving source that is provided on the fixed bar and moves the movable member along the fixed bar in the workpiece transfer direction, wherein the connecting portion of each feed driving mechanism includes:

an engaging portion that is provided to one of the slide member and the movable member; and an engaging portion that is provided to the other of the slide member and the movable member and engageable with the engaging portion, and the engaging portion is engagable with the engaged portion in a direction substantially orthogonal to a longitudinal direction of the pair of bar assemblies, wherein the bar connecting device of each bar assembly includes:

a fixed-side connecting portion that protrudes from An end of the fixed bar toward the movable bar;

a movable-side connecting portion that protrudes from an end of the movable bar toward the fixed bar to overlap with the fixed-side connecting portion; and holding means disposed in the fixed bar for holding the movable-side connecting portion against the fixed-side connecting portion by a holding member being advanced and retracted in a longitudinal direction of the fixed bar by air pressure, and wherein each bar driving mechanism moves the respective fixed bar in the direction substantially orthogonal to the longitudinal direction of the pair of bar assemblies relative to the respective movable bar such that the fixed-side connecting portion and the movable-side connecting portion are overlapped with each other or spaced from each other while the connecting portion engages with or disengages from the connecting portion.

14. The press machine according to claim 13, wherein each bar assembly further includes an additional fixed bar, and the movable bar of each bar assembly is arranged between the fixed bars.

15. The press machine according to claim 14, wherein both fixed bars of the bar assemblies are fixed to the bar driving mechanisms.

16. A bar detaching method of a workpiece transfer device of a press machine, wherein the workpiece transfer device of the press machine includes:

a pair of bar assemblies that are disposed substantially in parallel to a workpiece transfer direction;

a workpiece holder that holds a workpiece;

a respective feed driving mechanism that moves the workpiece holder in the workpiece transfer direction relative to and along each of the pair of bar assemblies; and a respective bar driving mechanism that drives each of the pair of bar assemblies at least either in a lift direction or in a clamp direction, wherein the pair of bar assemblies each include:

a fixed bar that is fixed on the respective bar driving mechanism;

a movable bar that is separable from the fixed bar; and a bar connecting device that connects the fixed bar and the movable bar, the fixed bar and movable bar of each bar assembly being substantially parallel to the work transfer direction, wherein each feed driving mechanism includes:

a slide member that is supported by and slidable along the movable bar of the respective bar assembly, the workpiece holder being provided in connection with the slide member;

a movable member that is supported by and slidable along the fixed bar of the respective bar assembly;

a connecting portion that connects the slide member and the movable member; and a feed driving source that is provided on the fixed bar and moves the movable member along the fixed bar in the workpiece transfer direction, wherein the connecting portion of each feed driving mechanism includes:

an engaging portion that is provided to one of the slide member and the movable member, and an engaged portion that is provided to the other of the slide member and the movable member and engageable with the engaging portion, and the engaging portion being engagable with the engaged portion in a direction substantially orthogonal to a longitudinal direction of the pair of bar assemblies, the method comprising:

moving the connecting portion of each bar assembly to a position corresponding to that of the bar connecting device via the feed driving mechanism; and releasing a connection of the connecting portion of each bar assembly to the bar connecting device by moving the fixed bar of the bar assembly in the direction substantially orthogonal to the longitudinal direction of the pair of bar assemblies relative to the movable bar of the bar assembly via the respective bar driving mechanism.

17. A bar detaching method of a workpiece transfer device of a press machine, wherein the workpiece transfer device of the press machine includes:

a pair of bar assemblies that are disposed substantially in parallel to a workpiece transfer direction;

a workpiece holder that holds a workpiece;

a respective feed driving mechanism that moves the workpiece holder in the workpiece transfer direction relative to and along each of the pair of bar assemblies; and a respective bar driving mechanism that drives each of the pair of bar driving mechanism that drives each of the pair of bar assemblies at least either in a lift direction or in a clamp direction, wherein the pair of bar assemblies each include:

a fixed bar that is fixed on the respective bar driving mechanism;

a moveable bar that is separable from the fixed bar; and a bar connecting device that connects the fixed bar and the movable bar, the fixed bar and movable bar of each bar assembly being substantially parallel to the work transfer direction, wherein each feed driving mechanism includes:

a slide member that is supported by and slidable along the movable bar of the respective bar assembly, the workpiece holder being provided in connection with the slide member;

a movable member that is supported by and slidable along the fixed bar of the respective bar assembly;

a connecting portion that connects the slide member and the movable member; and a feed driving source that is provided on the fixed bar and moves the movable member along the fixed bar in the workpiece transfer direction, wherein the connecting portion of each feed driving mechanism includes:

an engaging portion that is provided to one of the slide member and the movable member; and an engaged portion that is provided to the other of the slide member and the movable member and that is engageable with the engaging portion, and the engaging portion is engagable with the engaged portion in a direction substantially orthogonal to a longitudinal direction of the pair of bar assemblies, wherein the bar connecting device of each bar assembly includes:

a fixed-side connecting portion that protrudes from an end of the fixed bar toward the movable bar;

a movable-side connecting portion that protrudes from an end of the movable bar toward the fixed bar to overlap with the fixed-side connecting portion; and holding means disposed in the fixed bar for holding the movable-side connecting portion against the fixed-side connecting portion by a holding member being advanced and retracted in a longitudinal direction of the fixed bar by air pressure, wherein each bar driving mechanism moves the respective fixed bar in the direction substantially orthogonal to the longitudinal direction of the pair of bar assemblies relative to the respective movable bar such that the fixed-side connecting portion and the movable-side connecting portion are overlapped with each other or spaced from each other while the connecting portion engages with or disengages from the connecting portion, the method comprising:

moving the connecting portion of each bar assembly to a position corresponding to that of the bar connecting device via the feed driving mechanism; and releasing a connection of the connecting portion of each bar assembly to the bar connecting device by moving the fixed bar of the bar assembly in the direction substantially orthogonal to the longitudinal direction of the pair of bar assemblies relative to the movable bar of the bar assembly via the respective bar driving mechanism.

* * * * *